US006822543B1

(12) United States Patent
Subramanian et al.

(10) Patent No.: US 6,822,543 B1
(45) Date of Patent: Nov. 23, 2004

(54) SYSTEM AND METHOD FOR CONTROLLING TRIP UNIT MECHANICAL STRESS

(75) Inventors: Anantharam Subramanian, Secunderabad (IN); Ronald Ciarcia, Bristol, CT (US); Macha Narender, Hyderabad (IN); Luis A. Brignoni, Vega Alta, PR (US); Samuel Stephen Kim, Bristol, CT (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/670,676

(22) Filed: Sep. 24, 2003

(51) Int. Cl.[7] ..... H01H 71/16; H01H 71/40; H01H 77/04

(52) U.S. Cl. ..... 335/6; 335/23; 335/35; 335/43; 335/45

(58) Field of Search ..... 335/6, 21–23, 335/35–37, 43–45

(56) References Cited

U.S. PATENT DOCUMENTS

| | | | | |
|---|---|---|---|---|
| 3,858,130 A | | 12/1974 | Misencik | 335/18 |
| 4,616,199 A | * | 10/1986 | Oster | 335/35 |
| 5,864,266 A | * | 1/1999 | Mickelson et al. | 335/35 |

* cited by examiner

*Primary Examiner*—Ramon M. Barrera
(74) *Attorney, Agent, or Firm*—Cantor Colburn LLP

(57) ABSTRACT

A trip system for a circuit breaker includes a current sensor and a stop surface, the current sensor having a contact surface, a first end that is supported, and a second end with a degree of freedom. The current sensor, arranged for receiving an electric current, undergoes a first deflection in response to a first current and a second deflection in response to a second current, the first deflection resulting in clearance between the contact surface and the stop surface, and the second deflection resulting in contact between the contact surface and the stop surface.

14 Claims, 4 Drawing Sheets

SYSTEM AND METHOD FOR CONTROLLING TRIP UNIT MECHANICAL STRESS

BACKGROUND OF THE INVENTION

The present disclosure relates generally to a trip system for a circuit breaker, and particularly to a system and method for controlling the mechanical stress at a thermal-magnetic trip unit of a circuit breaker.

Electrical circuit breakers may employ a variety of trip systems for sensing an electrical current and for initiating a tripping action at the circuit breaker, including bimetallic, magnetic, and thermal/magnetic trip units. Magnetic trip units may include c-shaped magnets, oil-filled dashpots, coil-type solenoids, and the like. Thermal trip units may include bimetals, shape memory alloys, and the like. Each phase of a multi-phase circuit breaker has a separate current sensor for that phase, which interfaces with an operating mechanism through a common trip bar and latch arrangement. Motion at an individual trip unit is transferred to the common trip bar, which is then driven to release a latch coupled to the operating mechanism, thereby resulting in a trip condition. To properly set the trip unit tripping characteristics, circuit breaker manufacturing processes employ a calibration routine that coordinates the responsiveness of the trip unit to an electrical current and adjusts for dimensional variations and tolerances among and between the circuit breaker components. One such calibration routine involves the adjustment of a calibration screw that biases the bimetal to an initial position. However, during a short circuit condition, excessive resistance heating or magnetic repulsion forces may result in excessive deflection and cause mechanical stress at the trip unit, which may have the drawback of introducing variation into the calibration setting. Shunting contacts or flux shunts may be employed to redirect the electrical current or magnetic flux, respectively, under a short circuit condition, thereby reducing the resultant mechanical stress seen at the trip unit, but the shunting contacts and flux shunt may not be sufficient to prevent an overstress condition at the trip unit under a high short circuit condition. Accordingly, there is a need in the art for a trip system for a circuit breaker that overcomes these drawbacks.

SUMMARY OF THE INVENTION

In one embodiment, a trip system for a circuit breaker includes a current sensor and a stop surface, the current sensor having a contact surface, a first end that is supported, and a second end with a degree of freedom. The current sensor, arranged for receiving an electric current, undergoes a first deflection in response to a first current and a second deflection in response to a second current, the first deflection resulting in clearance between the contact surface and the stop surface, and the second deflection resulting in contact between the contact surface and the stop surface.

In another embodiment, a method for controlling the mechanical stress at a current sensor assembly of a circuit breaker is disclosed. One end of a current sensor of the current sensor assembly is restrained and the current sensor energized. The unrestrained portion of the energized current sensor is permitted to deflect freely, but prevented from deflecting freely prior to the mechanical stress level at the current sensor reaching the mechanical yield point stress of the current sensor material.

BRIEF DESCRIPTION OF THE DRAWINGS

Referring to the exemplary drawings wherein like elements are numbered alike in the accompanying Figures.

DETAILED DESCRIPTION OF THE INVENTION

An embodiment of the invention provides a trip system for a circuit breaker having a current sensor assembly and a stop surface, the stop surface being arranged for preventing a mechanical stress level at the current sensor assembly from exceeding the mechanical yield point stress of the material used in the current sensor assembly. While the embodiment described herein depicts a three-pole circuit breaker as an exemplary circuit breaker, it will be appreciated that the disclosed invention is also applicable to other circuit breakers, such as single-phase, two-pole, and four-pole circuit breakers for example.

Figure 1:
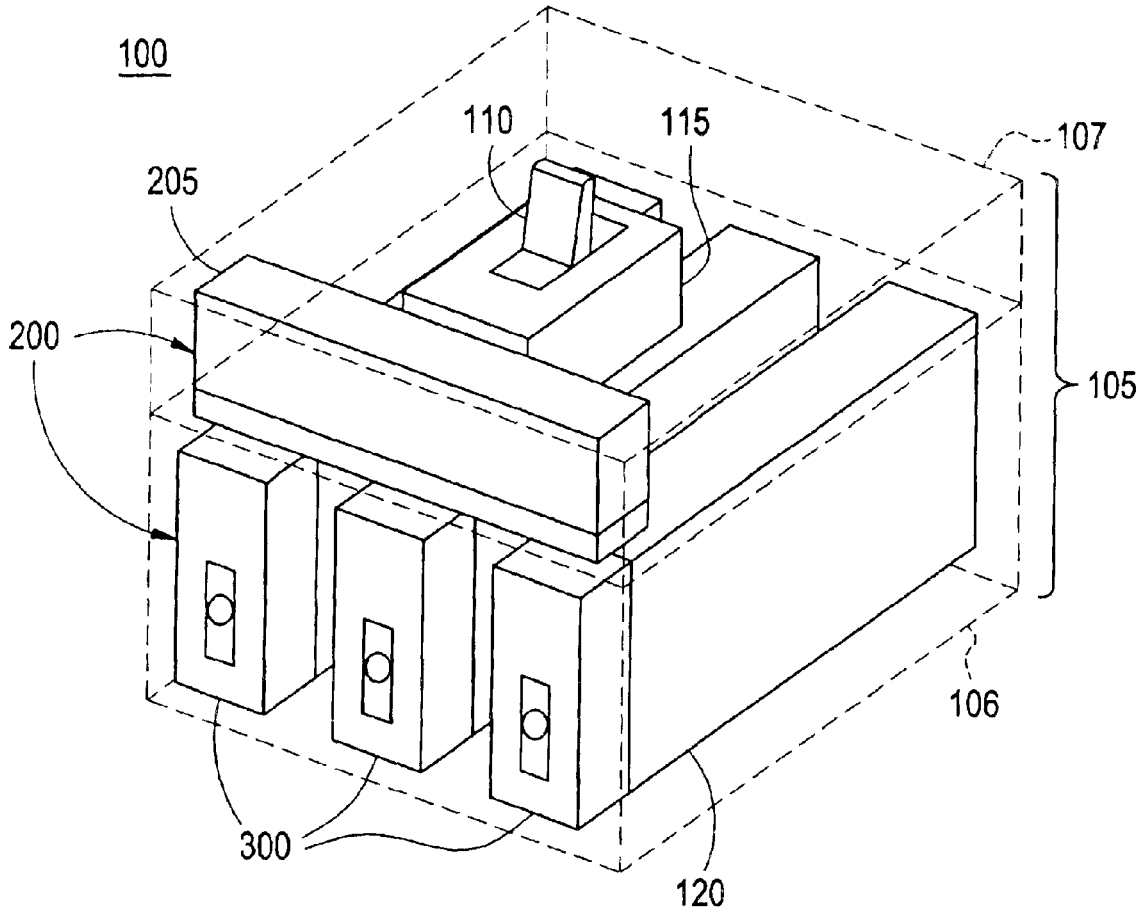
FIG. 1 depicts an isometric view of an exemplary circuit breaker for applying an embodiment of the invention.

FIG. 1 depicts an exemplary embodiment of a three-phase circuit breaker 100 having a housing 105, and an operating handle 110 for actuating an operating mechanism 115 for opening and closing a current path 120. A trip system 200 having phase components, such as a thermal-magnetic trip system 300 discussed later, and intraphase components 205, such as a crossbar or a trip bar (not shown), is in mechanical communication with operating mechanism 115 for tripping circuit breaker 100 and opening current path 120.

Figure 2:
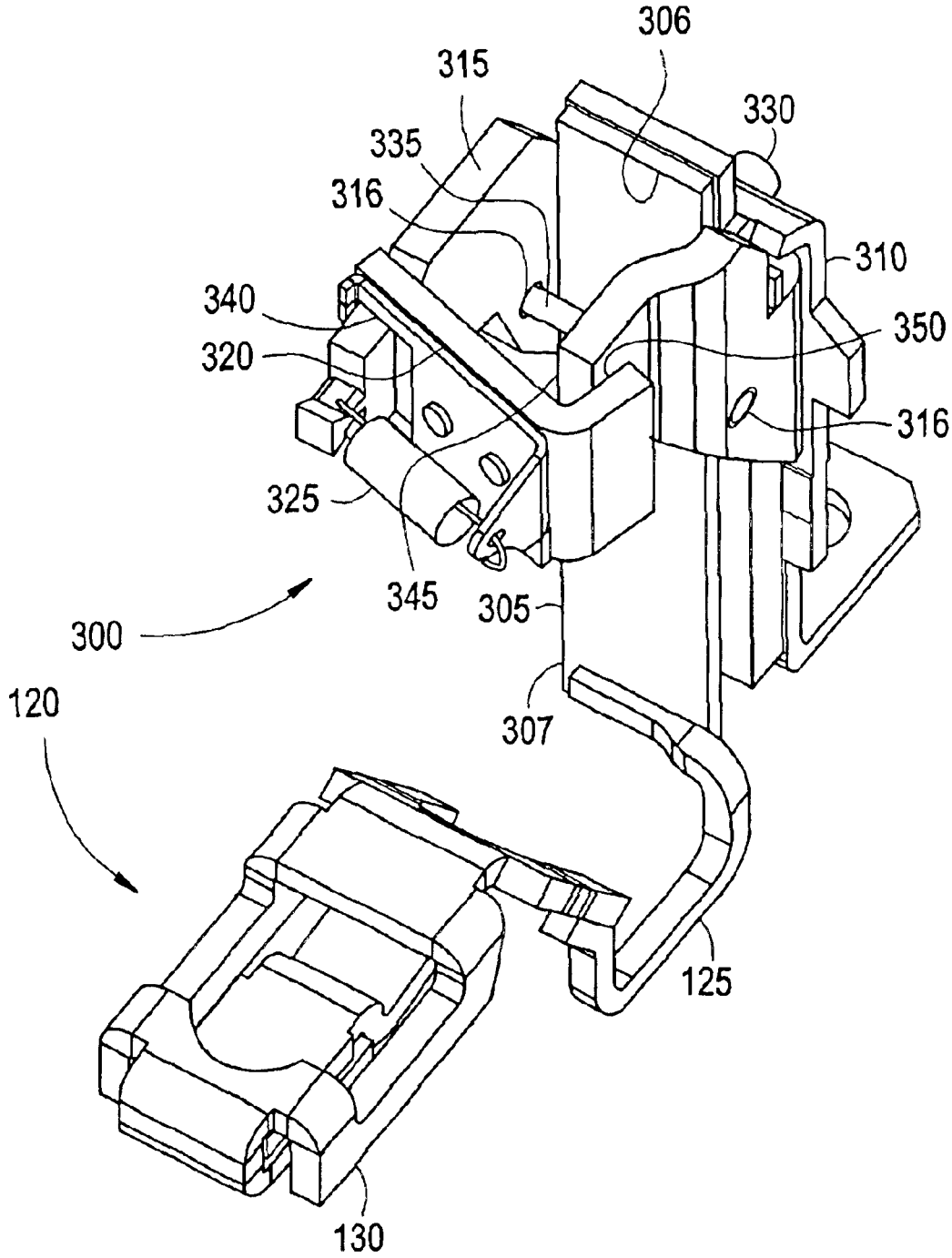
FIG. 2 depicts an isometric view of an exemplary trip system in accordance with an embodiment of the invention.

Referring now to FIG. 2, a thermal-magnetic trip system (alternatively referred to as a trip unit or current sensor assembly) 300 for one of the three phases of circuit breaker 100 is depicted as part of current path 120. Other parts of current path 120 that are shown include a flexible conductor 125, such as a copper braid for example, and a line strap 130. Current path parts not shown are omitted for clarity but may be readily contemplated by one skilled in the art. Trip system 300 includes a current sensor 305, such as a bimetal or a shape memory alloy for example, a terminal 310, a stationary flux path (alternatively referred to as a magnetic yoke or simply as a magnet) 315, a movable flux path (alternatively referred to as an armature) 320, a bias spring 325, a calibration screw 330, and a stop surface 335. Stop surface 335 may be a stop pin, such as a roll pin or a machined pin, or of any other suitable configuration for engaging bimetal 305, and may be made of steel or any other suitable material for stopping the deflection of bimetal 305. A first end 306 of bimetal 305 is bonded, brazed for example, to terminal 310, which provides a means of support for holding first end 306 stationary during bimetal deflection. First end 306 may also be supported by molded detail in housing 105. A second end 307 of bimetal 305 is bonded, brazed for example, to braid 125, and is unsupported, thereby providing a degree of freedom for second end 307 to deflect away from terminal 310 in response to bimetal 305 being resistively heated from an electric current in current path 120. Magnet 315 and armature 320 provide a flux path around bimetal 305, shown also in FIG. 3, and are coupled together at pivot 340 and pole faces 345, 350. Bias spring 325 is arranged to maximize the air gap between pole faces 345, 350. Magnet 315 may be attached to terminal 310 via a rivet 355 or other suitable attachment means, best seen in FIG. 3.

Figure 3:
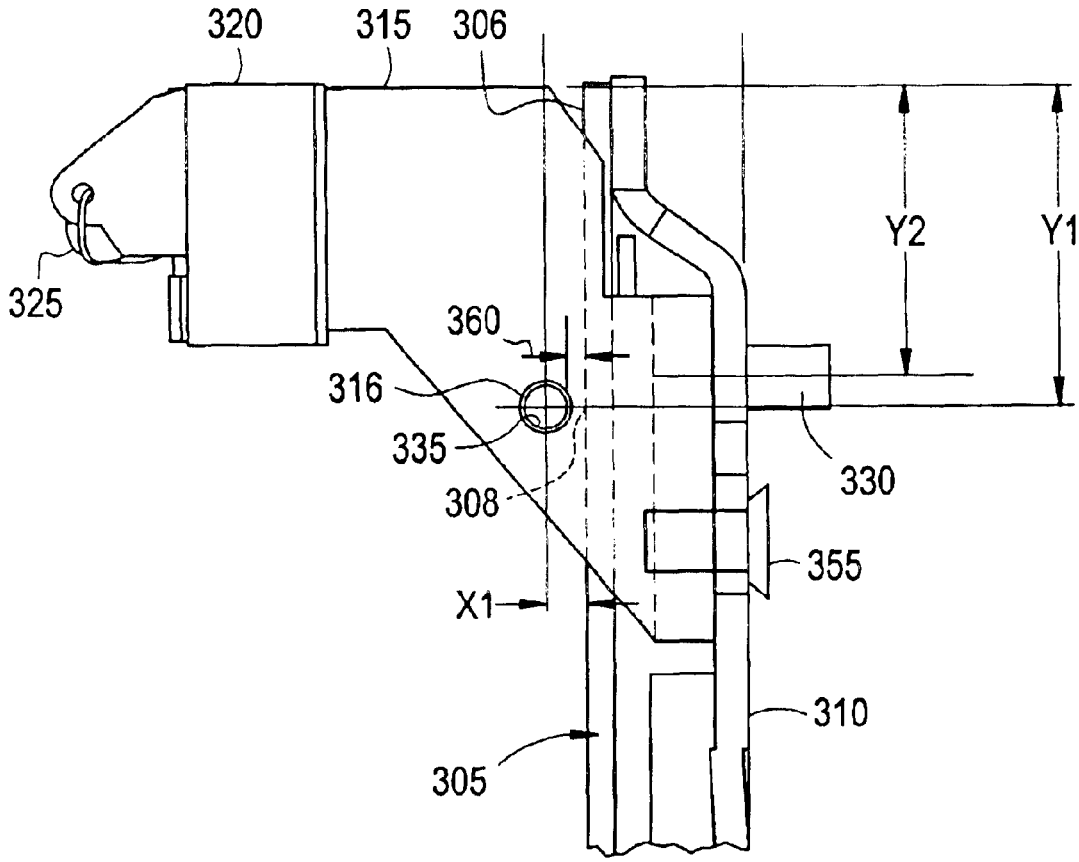
FIG. 3 depicts a side view of the trip system of FIG. 2 with some parts removed for clarity.

Referring now to FIG. 3, the position of stop pin 335 relative to bimetal 305 in the absence of an electric current in current path 120 is depicted having an air gap 360 between stop pin 335 and a contact surface 308 on bimetal 305. To establish the initial air gap 360, which reduces as bimetal 305 deflects in response to resistive heating, the center of stop pin 335 is positioned at a distance X1 from bimetal contact surface 308 and Y1 from first end 306 of bimetal 305. In comparison, calibration screw 330 is axially positioned perpendicular to terminal 310 at a distance Y2 from first end 306. In an embodiment, dimension Y2 is equal to or less than dimension Y1, thereby placing calibration screw 330 closer to first end 306 than stop pin 335, and dimension Y1 is equal to or less than half the overall length of bimetal 305, thereby placing stop pin 335 closer to first end 306 than to second end 307. Stop pin 335 may be supported by a press fit arrangement in holes 316 in magnet 315, as depicted in FIGS. 2 and 3, or by any other suitable support arrangement.

Figure 4:
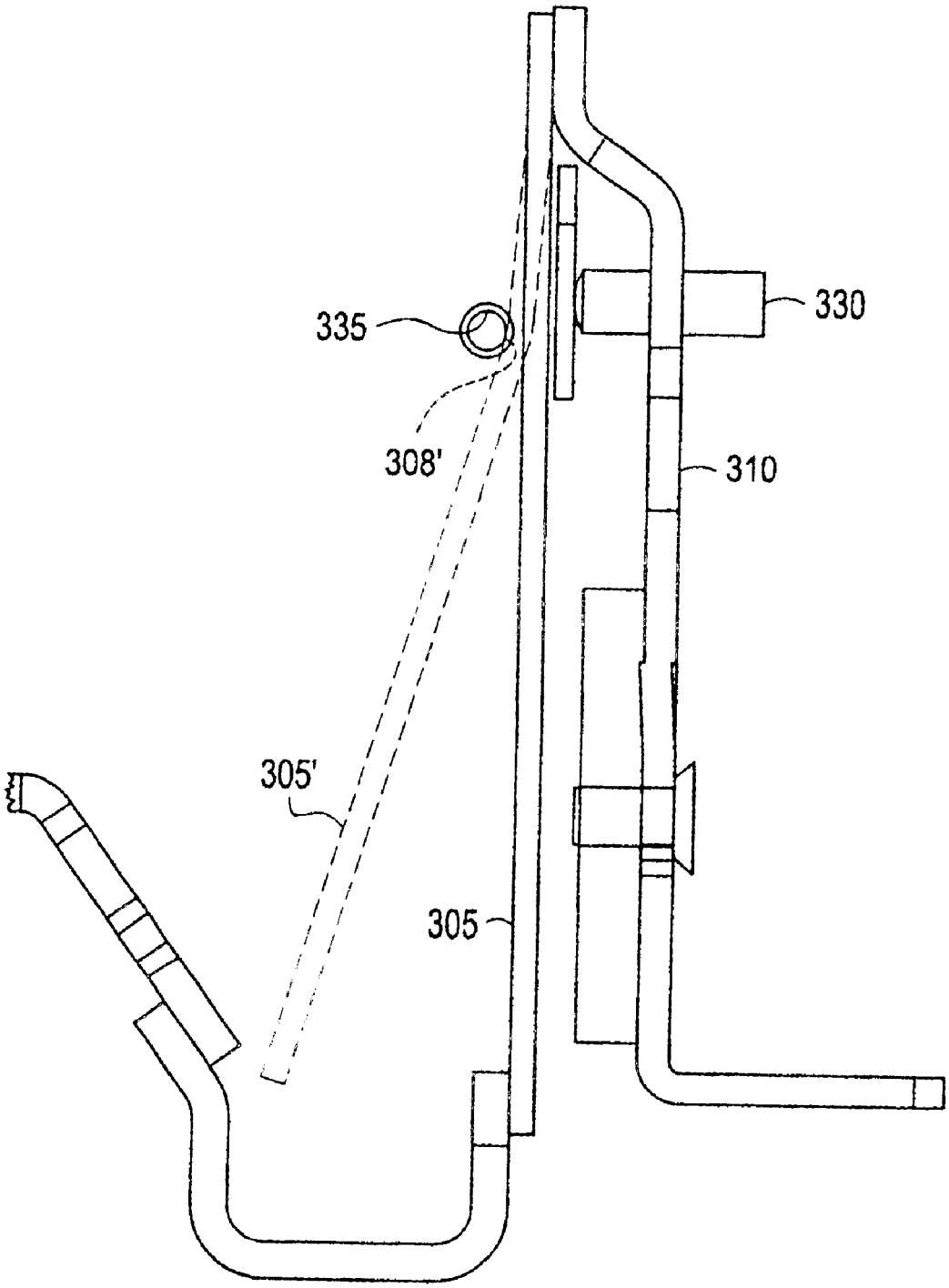
FIG. 4 depicts a side view of a portion of the trip system of FIG. 2 with an energized portion shown in phantom.

Under a first operating condition, a first level of current passes through current path 120 and bimetal 305, resulting in resistive heating and a first deflection of bimetal 305, with the deflection generally being in a direction away from terminal 310. The first level of current may or may not be sufficient to cause tripping of operating mechanism 115, depending on whether a trip threshold has been met or not, but is insufficient to result in contact between contact surface 308 and stop pin 335. Accordingly, the first level of current maintains some degree of air gap 360 between contact surface 308 and stop pin 335, with the air gap 360 at the first level of current being sufficient to permit trip unit 300 to trip operating mechanism 115 for opening current path 120. In contrast, and under a second operating condition, a second level of current passes through current path 120 and bimetal 305, resulting in resistive heating and a second deflection of bimetal 305, the second current level being substantially greater than the first current level and resulting in a second deflection that causes contact surface 308 to contact stop pin 335. In an embodiment, the first current level may be, for example, 50%, 100%, or 200% of the steady state current rating of trip unit 300, while the second current level may be, for example, 10,000% of the steady state current rating of trip unit 300. A second current level of 10,000% is referred to as a short circuit current and may be at a level of other than 10,000%. While flux paths 315, 320 are designed to be responsive to such short circuit currents for quickly tripping operating mechanism 115 to open current path 120, bimetal 305, being in the current path, is still exposed to such high current levels for a short period of time, which results in rapid resistive heating and deflection of bimetal 305. In the absence of stop pin 335, bimetal 305 may deflect to the point where either bimetal 305 generally, or terminal 310 at brazed end 306, generates a mechanical stress level that is in excess of the mechanical yield point stress of the respective material. However, with the use of stop pin 335, such overstressing may be avoided. Accordingly, in an embodiment having stop pin 335, the exemplary second deflection of bimetal 305 results in a mechanical stress level at bimetal 305 or terminal 310 that is less than the mechanical yield point stress of the respective material. FIG. 4 depicts in phantom bimetal 305' at the exemplary second deflection where deflected contact surface 308' is in contact with stop pin 335. By appropriately dimensioning X1, Y1, and Y2, overstressing at bimetal 305 and terminal 310 may be avoided without adversely effecting the calibration and operation of trip unit 300, and without adversely changing the calibration of trip unit 300 after exposure to an exemplary second current level.

By applying an arrangement in accordance with an embodiment described above, the mechanical stress at current sensor assembly 300 may be controlled by: restraining brazed end 306 of current sensor 305 via terminal 310 or mold detail in housing 105; energizing current sensor 305 either electrically, thermally, or magnetically, to cause deflection of current sensor 305; permitting free deflection of the unrestrained portion of the energized current sensor 305; and, preventing free deflection via stop pin 335 of the unrestrained portion of the energized current sensor 305 prior to the mechanical stress level at current sensor 305 or terminal 310 reaching the mechanical yield point stress of the respective material. As also discussed above, further control of the mechanical stresses at current sensor 305 and terminal 310 may be achieved by preventing free deflection of current sensor 305 at a point on current sensor 305 that is closer to first end 306 than to second end 307, and by preventing free deflection of current sensor 305 at a point on current sensor 305 that is further away from first end 306 than is the point of an applied calibration force from calibration screw 330.

As disclosed herein, some embodiments of the invention may include some of the following advantages: reduced bimetal stress in response to high current let through; reduced stress at the brazed joint of bimetal to terminal in response to high current let through; reduced variation in calibration after short circuit; reduced variation in trip unit response generally after short circuit; and, utilization of existing parts, such as the magnet, with added functionality.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A trip system for a circuit breaker, comprising:

a current sensor having a contact surface, a first end that is supported and a second end with a degree of freedom, the current sensor arranged for receiving an electric current and for generating a displacement at the second end in response thereto; and a stop surface disposed at a first distance from the first end and at a second distance from the contact surface, the stop surface being disposed closer to the first end than to the second end;

wherein the current sensor undergoes a first deflection in response to a first current and a second deflection in response to a second current, the first deflection resulting in clearance between the contact surface and the stop surface, and the second deflection resulting in contact between the contact surface and the stop surface.

2. The system of claim 1, wherein:

the second deflection results in a mechanical stress level at the current sensor that is less than the mechanical yield point stress of the current sensor material.

3. The system of claim 1, wherein:

the current sensor is a bimetal.

4. The system of claim 1, further comprising:

a terminal connected to the current sensor at the first end and disposed proximate the current sensor for at least a portion of the length of the current sensor, the terminal being disposed such that the current sensor deflects away from the terminal in response to an electric current.

5. The system of claim 4, further comprising:

a calibration screw axially disposed perpendicular to the terminal at a third distance from the first end, the third distance being equal to or less than the first distance.

6. The system of claim 4, wherein:

the second deflection results in a mechanical stress level at the first end that is less than the mechanical yield point stress of the current sensor material and less than the mechanical yield point stress of the terminal material.

7. The system of claim 4, further comprising:

a magnetic yoke defining a flux path proximate the current sensor, the magnetic yoke disposed in fixed relation to the current sensor and arranged for concentrating a magnetic flux associated with an electric current at the current sensor, the stop surface being supported by the magnetic yoke.

8. The system of claim 7, wherein:

the magnetic yoke is connected to the terminal.

9. The system of claim 7, wherein:

the stop surface is a pin made of steel.

10. A method for controlling the mechanical stress at a current sensor assembly of a circuit breaker, comprising:

restraining one end of a current sensor of the current sensor assembly;

energizing the current sensor to achieve a first deflection present a clearance between the current sensor and a stop surface;

energizing the current sensor to achieve a second deflection absent a clearance between the current sensor and the stop surface;

permitting free deflection of the unrestrained portion of the energized current sensor at the first deflection;

preventing free deflection of the unrestrained portion of the energized current sensor at the second deflection prior to the mechanical stress level at the current sensor reaching the mechanical yield point stress of the current sensor material; and preventing free deflection of the current sensor at a point on the current sensor that is closer to the restrained end than to the unrestrained end of the current sensor.

11. The method of claim 10, wherein the current sensor assembly further comprises a terminal connected to the current sensor at the restrained one end, and further comprising:

preventing free deflection of the unrestrained portion of the energized current sensor prior to the mechanical stress level at the terminal reaching the mechanical yield point stress of the terminal material.

12. The method of claim 10, wherein the current sensor is a bimetal.

13. The method of claim 10, wherein the energizing the current sensor, comprises:

electrically energizing the current sensor, thermally energizing the current sensor, magnetically energizing the current sensor, or any combination comprising at least one of the foregoing.

14. The method of claim 10, further comprising:

applying to the current sensor a calibration force; and preventing free deflection of the current sensor at a point on the current sensor that is further away from the restrained end than is the applied point of the calibration force.

* * * * *